US012161947B2

(12) United States Patent
Dumery et al.

(10) Patent No.: US 12,161,947 B2
(45) Date of Patent: Dec. 10, 2024

(54) COLLAPSIBLE TOY BOAT

(71) Applicant: Melissa and Doug, LLC, Wilton, CT (US)

(72) Inventors: Sofia Dumery, Westport, CT (US); Brett K. Almstead, Ridgefield, CT (US); George LeMoine, Trumbull, CT (US)

(73) Assignee: Melissa and Doug, LLC, Wilton, CT (US)

( * ) Notice: Subject to any disclaimer, the term of this patent is extended or adjusted under 35 U.S.C. 154(b) by 633 days.

(21) Appl. No.: 17/365,536

(22) Filed: Jul. 1, 2021

(65) Prior Publication Data

US 2023/0002009 A1 Jan. 5, 2023

(51) Int. Cl.

| | |
|---|---|
| ***A63H 23/02*** | (2006.01) |
| ***A63H 23/00*** | (2006.01) |
| ***A63H 33/00*** | (2006.01) |
| ***A63H 33/10*** | (2006.01) |
| ***B63B 5/24*** | (2006.01) |

(Continued)

(52) U.S. Cl.

CPC ..... *A63H 23/005* (2013.01); *A63H 23/02* (2013.01); *A63H 33/008* (2013.01); *A63H 33/102* (2013.01); *A63H 33/105* (2013.01); *B63B 5/24* (2013.01); *B63B 7/02* (2013.01)

(58) Field of Classification Search

CPC ..... A63H 23/00; A63H 23/005; A63H 23/02; A63H 23/10; A63H 33/00; A63H 33/102; B63B 5/24; B63B 7/02; B63B 7/06

USPC ..... 446/85, 88, 93, 107, 112, 113, 124, 160; 114/352, 353, 354

See application file for complete search history.

(56) References Cited

U.S. PATENT DOCUMENTS 702,065 A * 6/1902 Lynch et al. ..... F42B 4/18 102/355
1,333,109 A * 3/1920 Ford ..... B63B 7/06 114/345

(Continued)

FOREIGN PATENT DOCUMENTS

CN 302641996 11/2013
CN 303012666 11/2014

(Continued)

OTHER PUBLICATIONS

European Search Report for EP22182086, completed Oct. 27, 2022.

*Primary Examiner* — Alexander R Niconovich
(74) *Attorney, Agent, or Firm* — Aird & McBurney LP

(57) ABSTRACT

A play structure is formed from flexible struts supporting a fabric. The struts are inserted through pockets along the edges of the fabric. The struts are joined together by connectors at apexes of the structure. The struts form an upper frame and a lower frame. The upper and lower frames are connected by battens. The struts and battens hold the fabric in a selected shape, such as a sailboat. The battens are formed from flat, flexible members that are bent about their longitudinal axis to form a C-shaped cross section. Ends of the battens are inserted into curved batten receivers on the connectors. When a downward force is applied, the upper frame is pressed toward the lower frame. The battens bend and flatten to resiliently allow the structure to collapse. When the force is relieved, the battens resiliently resume their curved shape, restoring the structure to its original configuration.

17 Claims, 9 Drawing Sheets

(51) Int. Cl.
*B63B 7/02* (2020.01)
*B63B 7/06* (2020.01)

(56) References Cited

U.S. PATENT DOCUMENTS 1,670,936 A * 5/1928 Mcintyre ..... B63H 9/068 114/39.29
1,690,936 A * 11/1928 Eero ..... B63B 7/06 114/354
1,943,474 A * 1/1934 Goldberg ..... A63H 33/16 446/88
2,001,365 A * 5/1935 Lindstrom ..... A63H 23/02 114/356
2,028,543 A * 1/1936 Goldberg ..... A63H 33/16 446/88
3,108,295 A * 10/1963 Schor ..... B63B 7/06 16/389
3,397,710 A 8/1968 McElroy
3,696,772 A * 10/1972 Sundelin ..... B63B 15/02 114/39.28
3,748,670 A * 7/1973 Musson ..... B63B 7/06 114/354
3,796,004 A * 3/1974 Auerbach ..... A63H 33/103 446/107
4,124,910 A * 11/1978 Raymond ..... B63B 7/06 114/354
4,894,041 A * 1/1990 Dahlgren ..... A63H 23/00 446/160
4,963,115 A * 10/1990 Stowell Davin ..... B60B 37/10 280/30
5,070,665 A 12/1991 Marrin et al.
5,162,010 A * 11/1992 Krebs ..... A63H 33/14 446/901
D338,284 S 8/1993 Barreto, III et al.
5,352,149 A 10/1994 Melashenko et al.
D362,475 S 9/1995 Berres
6,196,152 B1 * 3/2001 Cacioppo ..... B63B 34/00 114/354
7,228,820 B1 6/2007 Kellogg et al.
D625,923 S 10/2010 Schiebl
8,157,094 B2 4/2012 Schiessl
8,573,239 B2 11/2013 Pritchard et al.
8,668,543 B2 3/2014 Manrique
8,708,765 B2 * 4/2014 Pope-Gusev ..... A63H 33/008 446/124
9,283,491 B2 * 3/2016 Pope-Gusev ..... A63H 33/008
2002/0111106 A1 8/2002 Bollman
2007/0079858 A1 * 4/2007 Chu ..... A63H 33/008 135/136
2009/0044743 A1 * 2/2009 Wagenknecht ..... B65D 5/244 229/198.2
2014/0155183 A1 * 6/2014 Niu ..... E04H 15/006 472/136
2014/0187117 A1 7/2014 Pope-Gusev
2016/0107095 A1 * 4/2016 Fries ..... A63H 33/008 472/136
2020/0376401 A1 12/2020 Blundell

FOREIGN PATENT DOCUMENTS

CN 303043059 12/2014
CN 304151956 5/2017
EP 3364822 8/2018
WO 2010109370 9/2010

* cited by examiner

COLLAPSIBLE TOY BOAT

BACKGROUND OF THE INVENTION

1. Field of the Invention

The present disclosure relates to a play structure with collapsible members that safely yield when subject to compressive forces and that resiliently rebound to form a representative shape. In particular, the present disclosure is related to a play structure that represents a vehicle such as a boat, including vertically oriented battens that collapse when pressed downward so that the battens do not create a protrusion hazard.

2. Description of the Related Art

Play structures allow children to imaging they are operating vehicles, or inhabiting buildings. Such structures may be formed by fitting fabric sheets over a frame.

Known play structures may include a continuous flexible wire loop that runs through one or more pockets along the edge of a fabric sheet. When the wire is folded onto a compact configuration and held, for example, in a storage bag or other container, the play structure remains collapsed. When compression of the folded wire is release, the wire loop expands. The fabric sheet is supported by the expanded wire to create the play structure.

The shape that can be achieved by play structures supported by a flexible wire are limited. The wire itself must be a closed loop. A loose wire end could create a protrusion hazard for children playing with the structure. It may be difficult to create realistic looking shapes, for example, the outlines of a boat, where the shape is supported by a continuous wire loop. Forming an angular apex, such as the tip of the bow of a boat, or crisp corners on the back of the stern, may be difficult using known techniques.

Play structures formed from fabric sheets supported by wire loops may not collapse to as small a storage configuration as might be desirable. The resilient wire used to form the loop may have a minimum radius of curvature that limits how compact the coiled wire can be compressed. Bending the wire in too small a radius may deform the wire and damage the structure.

Known play structures supported by wire loops may be difficult to repair if they are damaged. Typically, if the wire of such known play structures is kinked or broken, the structure cannot be repaired and must be disposed of. In addition, if the wire were broken, the loose end may be sharp and could create a hazard for children playing with the structure.

To create a more realistic experience for a child playing with a play structure, it may be necessary that the structure have more rigidity than can be achieved with a wire loop, at least for certain portions of the structure. For example, where the play structure represents a vehicle such as a car or boat, providing sides that are relatively stiff may give the child the sensation of being inside a solidly constructed structure. Where the sides of a play structure are formed by a flexible wire loop, it may be difficult to create a sufficiently stiff side to the structure.

Providing parts of a structure that are relatively stiff according to know embodiments may create a safety hazard if the parts are formed in a manner that would allow a stiff protruding member to extend vertically. A vertical protrusion could cause injury if a child were to fall on it or abruptly sit down on it.

BRIEF SUMMARY OF THE INVENTION

Embodiments of the disclosure provide an improved structure for children's toys. Such embodiments provide resilient structures that provide the sensation of sitting to standing in the structure without creating a protrusion hazard. Such structures may include a vehicle such as a boat, car, or airplane. According to one aspect of the disclosure, there is provided a children's structure that is easy to assemble, relatively inexpensive to manufacture, and that provides an aesthetically pleasing shape. According to another aspect of the disclosure there is provided a structure that collapses easily when a child sits or presses down on vertical components of the structure. These embodiments reduce the risk that a member forming the structure with present a protrusion hazard.

According to another aspect of the disclosure, a play structure is formed from components that can be easily joined and separated from one another to allow the toy to be disassembled for storage and reassembled for play.

According to another aspect of the disclosure, the structure is formed from components that are simple to manufacture and can be formed from inexpensive materials.

According to another aspect of the disclosure, toys embodying the disclosed structure can be created with a variety of shapes and configurations using common structural components.

According to another aspect of the disclosure, toys embodying the disclosed structure are lightweight and easy to store and transport.

According to another aspect of the disclosure, toys embodying the disclosed structure are assembled from components that are easily manipulated by a child, this providing a learning opportunity, a group play experience, and a sense of satisfaction when the child assembles the structure with the help of an adult or other child.

According to another aspect of the disclosure, toys embodying the disclosed structure are durable and can resiliently spring back to their intended shape when impacted, stepped on, or dropped. Such toys may include vertically oriented structures like flags, goalposts, and the like that need to remain upright but that can easily flex away from a vertical orientation so as not to create a protrusion hazard.

BRIEF DESCRIPTION OF THE DRAWINGS

The above and/or other aspects of the disclosure will be more apparent by describing in detail exemplary embodiments of the disclosure with reference to the accompanying drawings, in which.

DETAILED DESCRIPTION OF EXEMPLARY EMBODIMENTS

Figure 1:
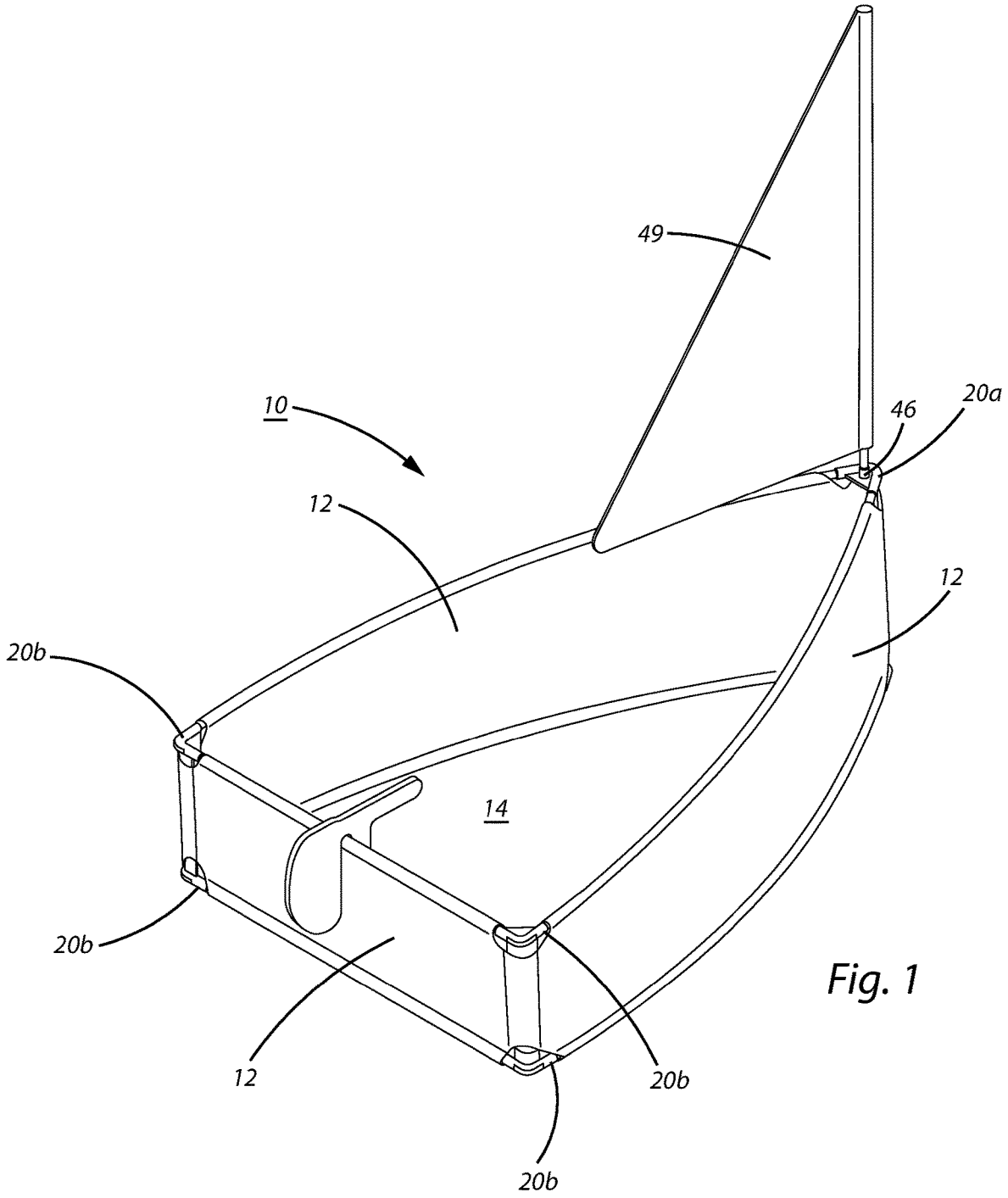
FIG. 1 is a perspective view of a collapsible toy boat according to an embodiment of the disclosure.

Exemplary embodiments of the disclosure will now be described below by reference to the attached Figures. The described exemplary embodiments are intended to assist the understanding of the invention and are not intended to limit the scope of the invention in any way. Like reference numerals refer to like elements throughout.

FIG. 1 shows a toy play structure 10 according to one embodiment of the disclosure. In this exemplary embodiment, the structure forms the shape of a sailboat. The disclosure is not limited to this shape and includes, but is not limited to, structures with a variety of shapes, for example, vehicle shapes like a car, truck, fire engine, or train, and the like, building shapes like a house, a store, a swimming pool, a garage, a ball pit, and other shapes. In addition, as will be explained below, embodiments according to the disclosure can be used to support a variety of objects, for example, flag poles, goalposts, racetrack finish lines, and the like.

As shown in FIG. 1, the play structure 10 is formed from fabric panels 12 forming the sides and stern of the boat. A fabric bottom 14 may be formed from the same fabric as the sides 12. According to one embodiment, fabric bottom 14 is formed from an abrasion resistant material, for example, a laminated fabric or tarp material, to provided better durability. According to one embodiment, the edges of fabric bottom 14 are sewn to the edges of panels 12. Pockets are formed along the edges of the panel 12 where they form the "gunwales" of the boat and also along the bottom edges of panels 12 where they join fabric bottom 14. Struts 22, as shown in FIGS. 2 and 3, are inserted through these pockets to create a resilient support to hold the fabric panels in the desired shape, for example, a sailboat.

Figure 2:
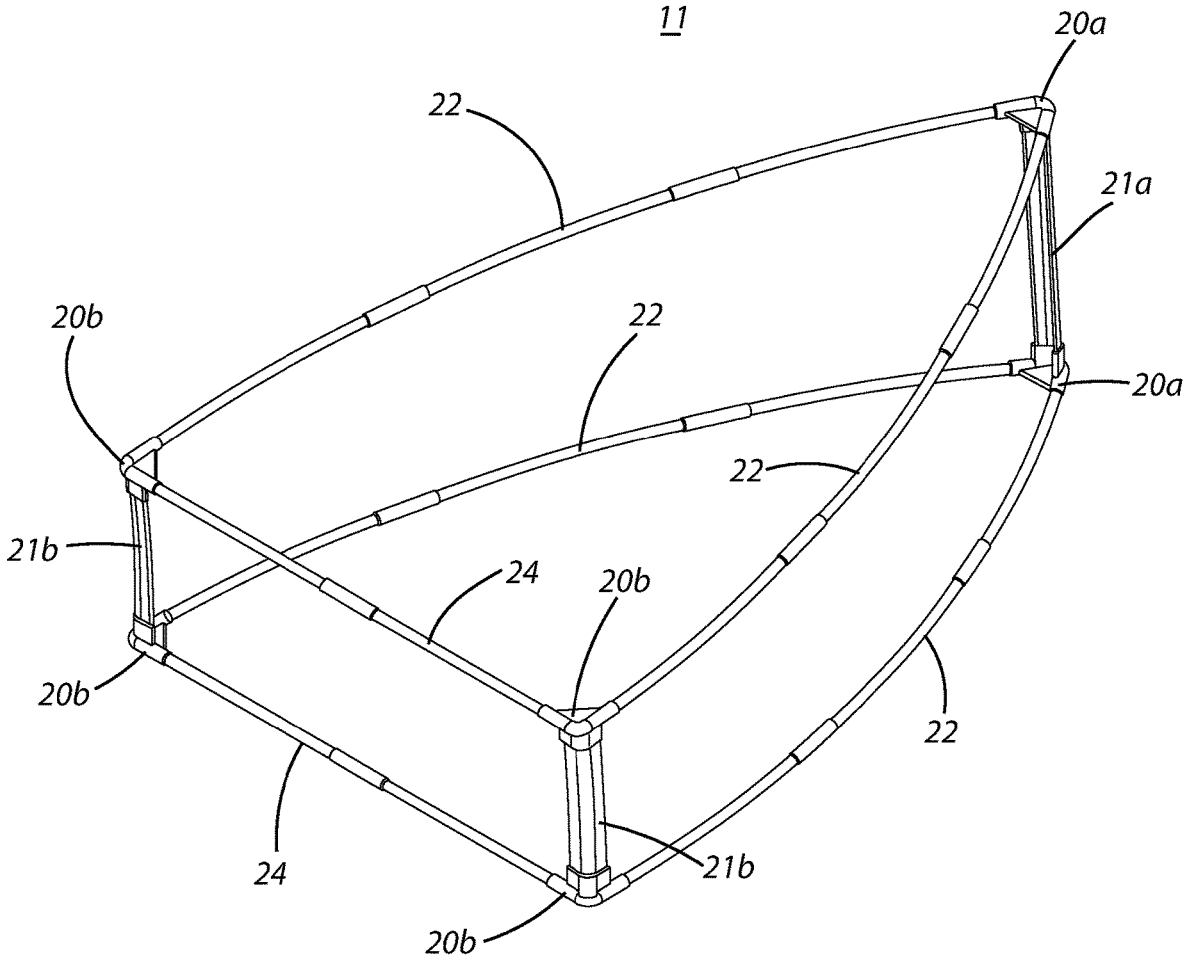
FIG. 2 is a perspective view of a frame for the toy boat of FIG. 1.
Figure 3:
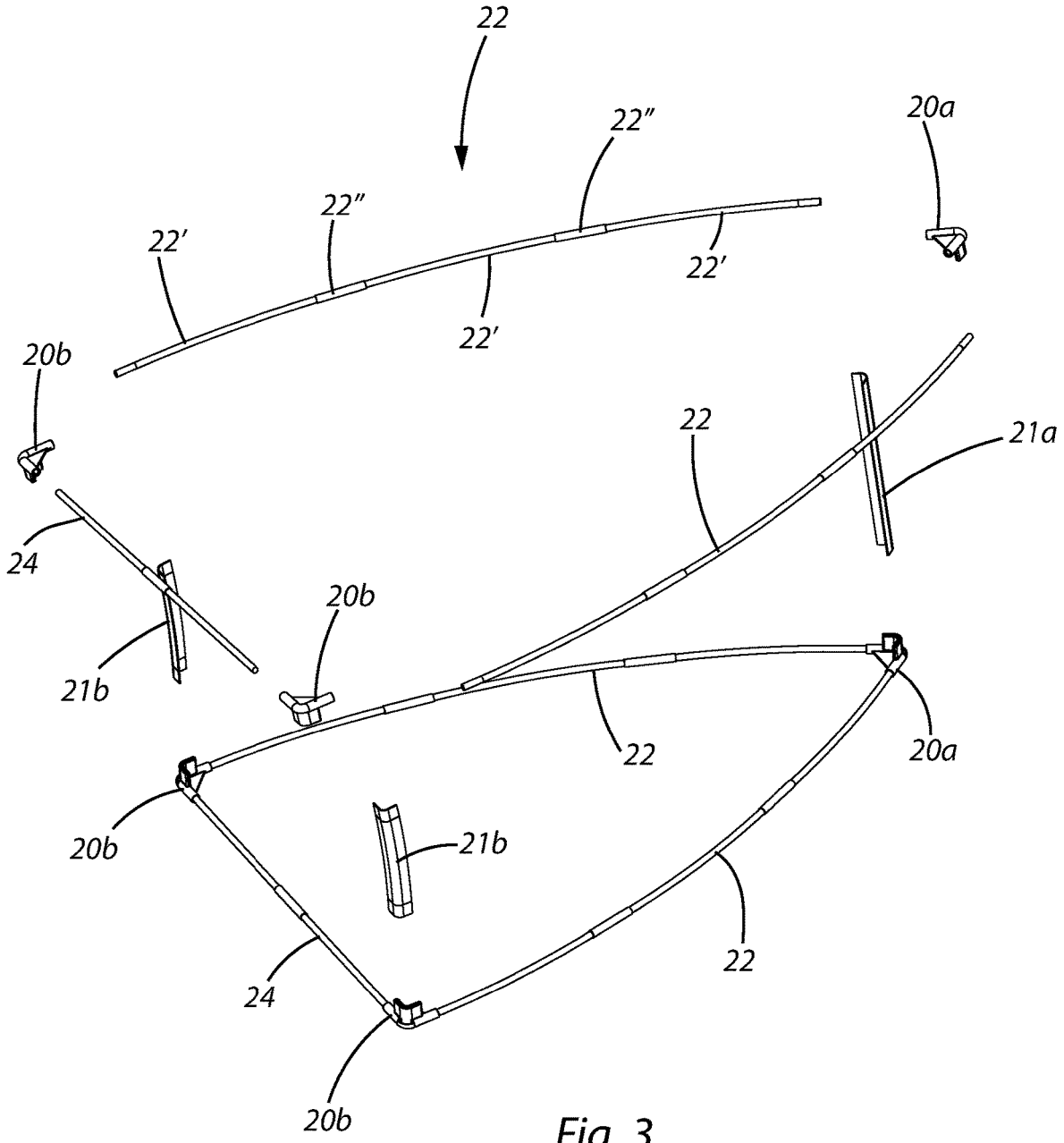
FIG. 3 is an exploded view of the frame of FIG. 2.

FIG. 2 shows the frame of the boat 11 assembled without the fabric. FIG. 3 shows an exploded view of the frame. Struts 22, 24 are arranged along the upper and lower edges of the boat shape. According to one embodiment, struts 22 along the sides of the boat are longer than struts 24 forming the stern of the boat. Struts 22, 24 according to one embodiment, are formed from flexible rods like those used to support camping tents. As shown in FIG. 3, rods 22 may include segments 22' that can be joined by inserting the end of one segment into a collar or ferrule 22" of an adjacent segment in a telescoping fashion. This arrangement allows the toy to be disassembled and stored in a small package. According to another embodiment, struts may include an elastic strap (not shown) that extends through a hollow space inside the segments that joins the segments to one another so the rod segments remain together when disassembled.

Figure 4A:
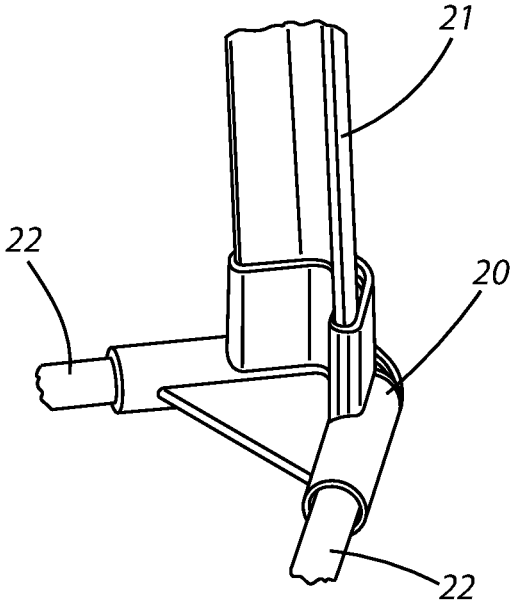
FIGS. 4A and 4B are perspective views of battens and connectors of the embodiment of FIG. 1.
Figure 4B:
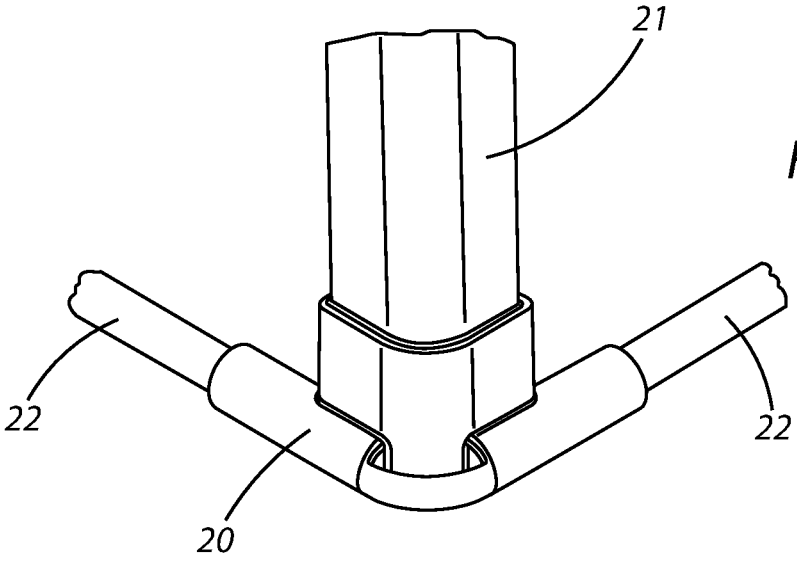
Figure 5A:
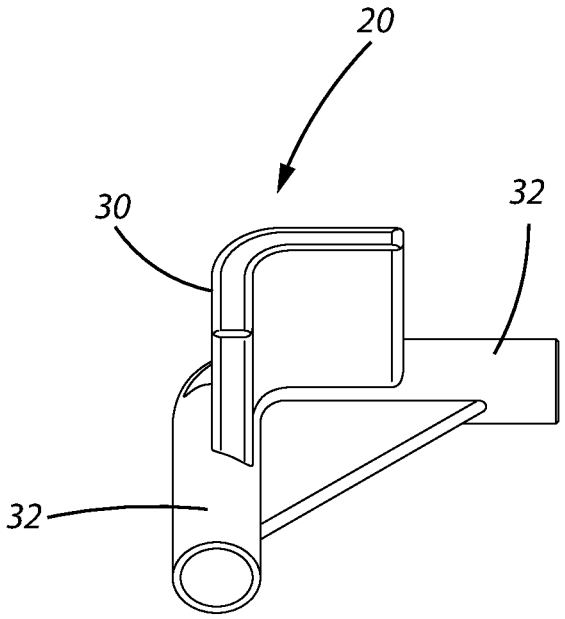
FIG. 5A is a perspective view and FIG. 5B is a top view, respectively, of a connector of the embodiment of FIG. 1.
Figure 5B:
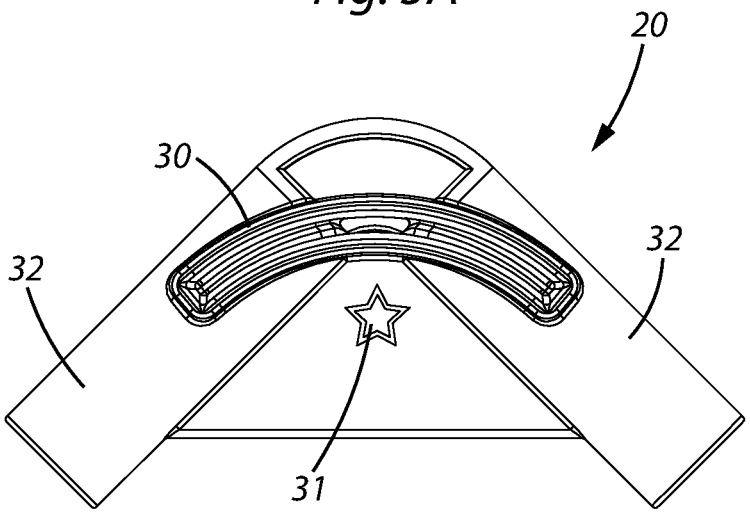

Ends of struts 22, 24 are joined at the bow and stern of the boat by connectors 20. FIGS. 4A and 4B show exemplary embodiments of connectors 20 joining struts 22, 24. FIGS. 5A and 5B show a connector 20 in detail. The connector 20 includes one or more strut receivers 32. The internal surface of the strut receivers 32 are shaped to form an interference fit with the ends of struts 22. According to one embodiment, the inside diameter of strut receivers 32 is tapered so that as the end of strut 22 is inserted, a tight fit is created to secure the strut with the connector. Connector 20 includes batten receiver 30 to join with batten 21, as shown in FIGS. 4A and 4B.

Strut receivers 32 may be arranged at an angle with respect to one another to form the desired shape of the completed frame. In the embodiment of FIG. 1, the angle between strut receivers 32 of the connectors 20*a* at the bow of the boat is about 70 degrees, creating a realistic tapered bow for the boat. The angle between strut receivers 32 of the connectors 20*b* at the stern of the boat is about 90 degrees, creating a realistic looking square stern for the boat. For embodiments where different configurations of strut receivers 32 and batten receivers 30 are provided, such as boat 10, the connectors 20*a*, 20*b* may include a distinguishing marking 31, such as shown in FIG. 5B. In the embodiment of FIG. 1, connector 20*a*, that forms the bow of the boat, has a "star" symbol is embossed on the connector.

Connectors 20*a*, 20*b* may be formed with a variety of orientations between strut receivers 32 to achieve other shapes for the collapsible toy, for example, square corners on a truck shape, a tapered bow and stern on a canoe shape.

In the exemplary embodiment, connectors are shown with two strut receivers 32 but the connectors could be formed with a single receiver or with more than two receivers. Strut receivers 32 are shown as being in substantially a single plane but the disclosure is not limited to this arrangement. Depending on the shape of the play structure (or other structure) formed by the struts 22, the strut receivers 32 can be set at a variety of angles to one another.

According to some embodiments, as described below, one or more of the connectors 20 are formed with no strut receiver, and instead include a structure such as a "peg" to insert into the soil and/or a coupling to support a flag, goalpost, or other object that needs to be supported vertically but that can easily flex away from a vertical orientation so as not to present a protrusion hazard.

As can be seen in FIGS. 2 and 3, at the corners of the structure 10, are vertically oriented battens 21*a*, 21*b*. In this embodiment, batten 21*a* at the bow of the boat is somewhat longer than the battens 21*b* at the stern of the boat. This arrangement gives the boat shape a more realistic appearance with a high bow sloping to a lower stern. In addition, by providing a lower portion of the "gunwale" of the boat near the stern, the structure is easier for small children to enter while the higher portion of the gunwale near the bow gives the child a sense of being enclosed in the boat.

Figure 6A:
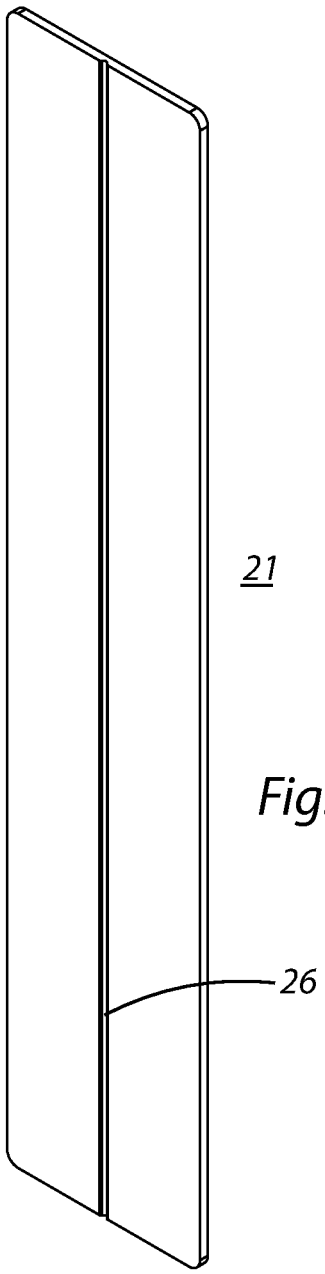
FIGS. 6A, 6B, and 6C are a perspective view, a front view, and an end view, respectively of a batten according to the embodiment of FIG. 1.
Figure 6B:
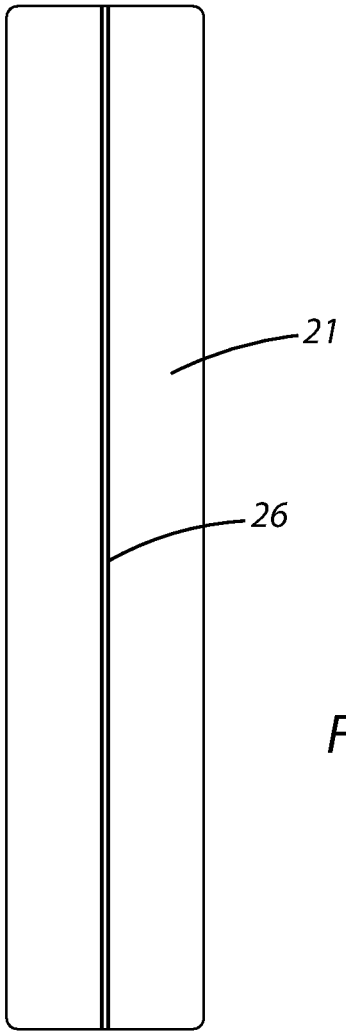
Figure 6C:
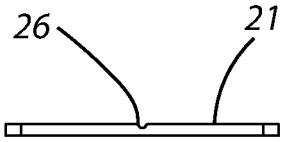

FIGS. 6A, 6B, and 6C show detailed view of batten 21 unconnected from the connectors 20. Batten 21 is formed from a flat strip of a flexible material. The material forming the battens 21 may be a flexible or elastomeric polymer. According to some embodiments, batten 21 is formed from high density polyethylene (HDPE), polyvinyl chloride (PVC), polyamide polymers (Nylon), and the like. According to one embodiment, a notch 26 is provided along the center line of the strip of material. The notch helps facilitate bending batten into a C-shaped cross section when the batten 21 is inserted into batten receiver 30 on connector 20. According to other embodiments, instead of providing battens 21 as flat members, the battens can be formed with a curved cross section about a longitudinal axis of the batten.

FIGS. 4A and 4B show batten 21 inserted into connector 20. Batten receiver 30 has an arcuate, curvilinear cross section and is open at one end. Batten 21 is joined with connector 20 by bending the batten about its longitudinal axis so that it is curved substantially the same as the arcuate batten receiver 30 and then inserting an end of the batten 21 into batten receiver 30. The width of the batten is equal to or less than the length along the curvilinear cross section of the batten receiver 30. Notch 26 along the axis of batten 21 may allow the batten to more easily bend to the arcuate shape of the batten receiver. As shown in FIG. 2 and exploded view in FIG. 3, connectors 20*a*, 20*b* are joined with both ends of each batten 21*a*, 21*b* to form frame 11.

As shown in FIG. 1, the side fabric 12 and bottom fabric 14 have openings at the corners where struts 22, connectors 20*a*, 20*b*, and battens 21*a*, 21*b* are joined. To assemble structure 10, struts 22 are assembled by joining strut segments 22' together end to end using collars 22". Struts 22 are inserted through pockets formed in the side fabrics 12 and bottom fabric 14. Struts 24 are inserted through pockets formed along the top and bottom edges of the stern fabric. Ends of struts 22, 24 are fitted to strut receivers 32 on connectors 20*a*, 20*b*. Battens 21*a*, 21*b* are bent to a curvilinear shape about their longitudinal axes to conform to the curved cross section of batten receivers 30 and inserted into the batten receivers.

Figure 7A:
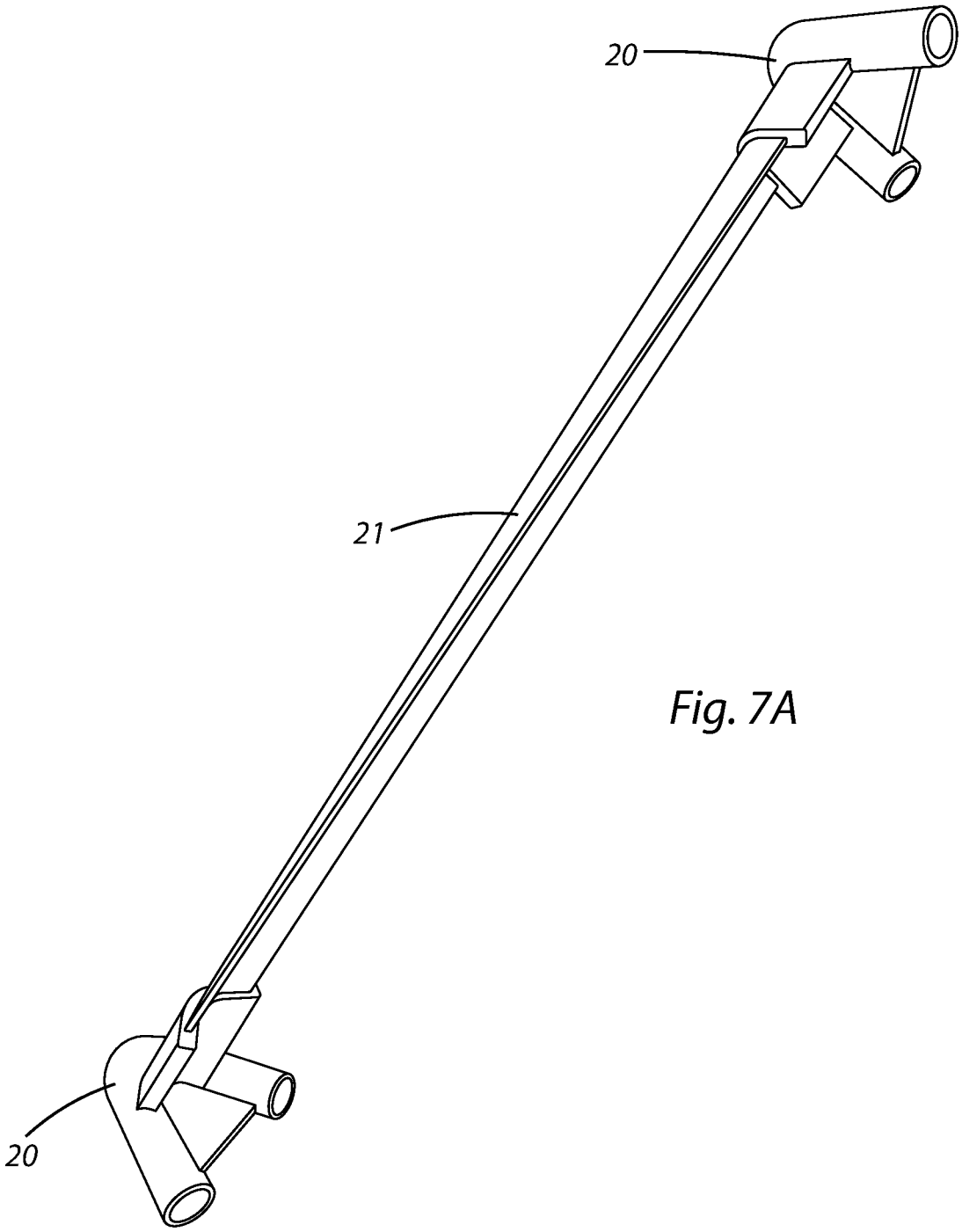
FIGS. 7A and 7B are perspective views of connectors and a batten of the embodiment of FIG. 1, with FIG. 7A showing the batten uncompressed and FIG. 7B showing the batten subject to a force along a longitudinal axis of the batten.
Figure 7B:
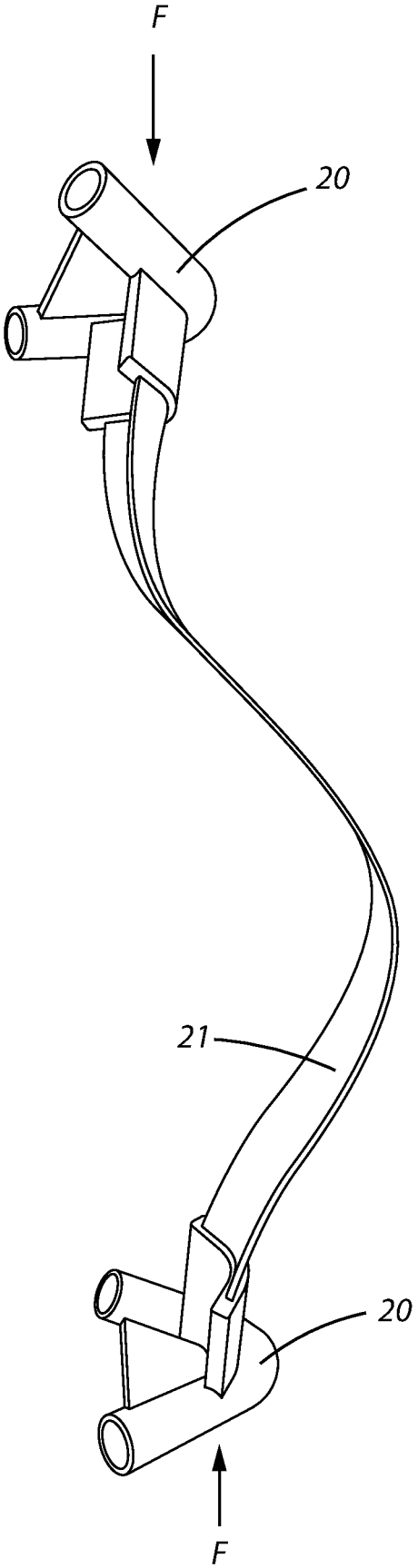

FIGS. 7A and 7B show batten 21 and connectors 20 separate from the rest of structure 10. As shown in FIG. 7A, when no compressive force is applied to the batten, the batten is substantially straight with the cross section of the batten substantially the same as the curvilinear cross section of the batten receivers 30. This holds the upper portion of the boat structure 10 shown in FIG. 1 at its maximum height. Because the batten 21 has a curved configuration as a result of being held in arcuate batten receivers 30, the batten provides support for the structure. According to one embodiment, the curved shape of batten 21 has a greater stiffness than when the batten is not curved, that is, as shown in FIG. 6A. As shown in FIG. 7B, when compressive force is applied, a portion of the batten 21 between connectors 20 flattens, allowing the batten to give way. Notch 26 along the axis of batten 21 may facilitate the flattening of the batten when force is applied. As a result of the shape of batten 21, when downward force is applied to toy 10, for example, when a child steps on the structure or sits down on it, the structure readily collapses and does not cause injury. When the force is relieved, battens 21 resume their curvilinear cross section (imposed on the batten by the curvilinear cross section of pattern receivers 30) and the toy resumes its original shape.

By joining struts with connectors according to embodiments of the disclosure, a realistic shape for the overall structure can be achieved, for example, clean, crisp corners at the stern and a tapered bow of a sailboat. Such a shape may not be possible using known techniques. At the same time, battens according to embodiments of the disclosure allow the structure to safely collapse and resiliently rebound to form a safe and durable play structure.

According to some embodiments, connectors 20 may include additional structures. In the embodiment shown in FIG. 1, connector 20*a* may include a boss 46 or clip or other structure on its upper surface to support a sail 49 or other accessory. According to other embodiments, connectors 20 may be adapted to support other types of toys and sporting equipment, for example, flags or goalposts, that are held upright, but that easily bend away from vertical so as not to create a protrusion hazard.

Figure 8:
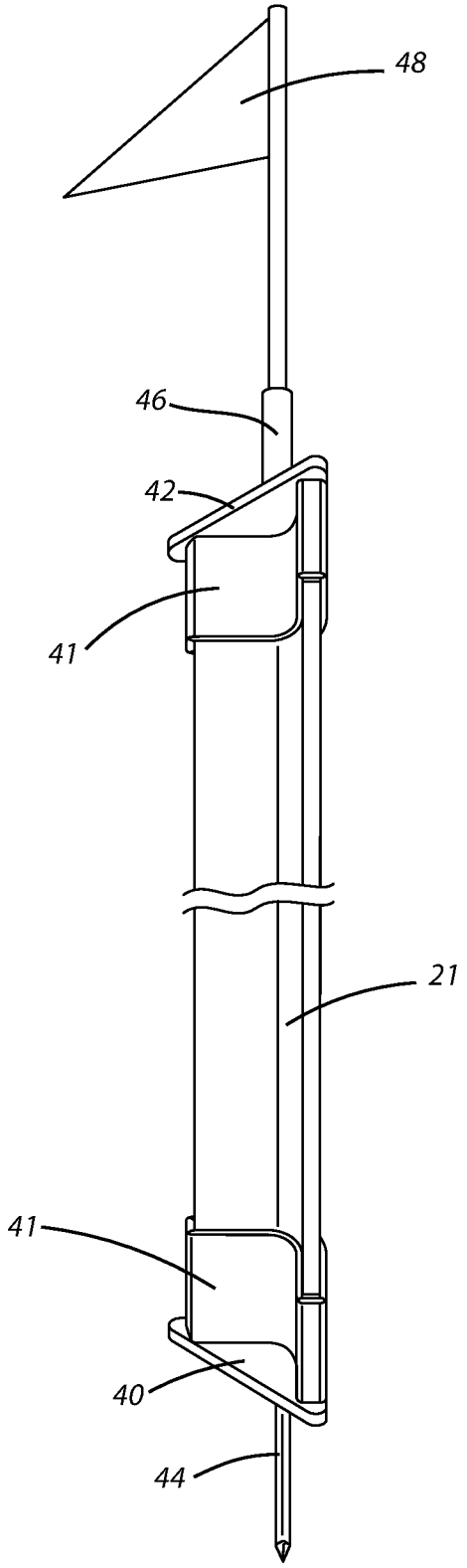
FIG. 8 is a perspective view of another embodiment of the disclosure.

FIG. 8 shows a further embodiment of the disclosure. Lower connector 40 includes a spike or peg 44 adapted to be inserted into soil or other surface to fix the assembly in the ground. Alternatively, lower connector 40 could be affixed to a floor or exercise mat using a fastener such as a screw or adhesive patch instead of a spike. Batten 21 is inserted into a batten receiver 41 of bottom connector 40, as in the previous embodiments. Upper connector 42 is provided at the top of batten 21, with the top of the batten inserted into batten receiver 41. A boss or other connective member 46 is provided on the top surface of upper connector 42. Boss 46 is designed to hold a structure such as a flag 48. As with previous embodiments, batten 21 is held in a curved configuration, giving the structure some rigidity to support the flagpole, which might form a portion of a goal or target for a sporting event. Should a person impact the flag, or land on top of the structure, batten 21 flexes, as illustrated in FIGS. 7A and 7*b* to safely give way to avoid presenting a protrusion hazard.

While the invention has been particularly shown and described with reference to exemplary embodiments thereof, the invention is not limited to these embodiments. It will be understood by those of ordinary skill in the art that various changes in form and details may be made therein without departing from the spirit and scope of the invention as defined by the following claims. Therefore, the description should not be construed as limiting the scope of the invention.

What is claimed is:

1. A batten assembly for a collapsible toy comprising:

a first connector having a first batten receiver, a second connector having a second batten receiver, wherein the first batten receiver and second batten receiver each have a curvilinear cross section and a path length along the curvilinear cross section; and a batten having a longitudinal axis and a batten width perpendicular to the longitudinal axis, wherein the batten width is less than or equal to the path length, wherein the batten is flexed about the longitudinal axis to conform to the curvilinear cross section and wherein a first end of the batten is removably inserted in the first batten receiver and a second end of the batten is removably inserted in second batten receiver.

2. The batten assembly of claim 1, wherein the batten further comprises a notch extending along the longitudinal axis.

3. The batten assembly of claim 1, wherein the batten is formed from a resiliently deformable material, wherein, in response to a compressive force along the longitudinal axis, at least a portion of the batten flexes to a flat cross section.

4. The batten assembly of claim 3, wherein the resiliently deformable material comprises a polymer.

5. The batten assembly of claim 4, wherein the polymer is high density polyethylene (HDPE), polyvinyl chloride (PVC), or a polyamide polymer.

6. The batten assembly of claim 5, wherein the first connector and the second connector each comprise a respective pair of strut receivers, wherein the pairs of strut receivers each define a plane substantially perpendicular to the longitudinal axis.

7. The batten assembly of claim 6, wherein the second connector comprises a boss adapted to receive a vertical member.

8. The batten assembly of claim 1, wherein one or more of the first connector and second connector further comprises one or more strut receivers adapted to receive respective struts.

9. The batten assembly of claim 1, wherein the first connector is adapted to be fixed to a floor, an exercise mat, or a soil surface.

10. The batten assembly of claim 9, wherein the vertical member is a flag, a goalpost, or a target for a sporting event.

11. A collapsible toy comprising:

a fabric having a fabric surface and a plurality of pockets arranged along edges of the fabric surface;

a first plurality of struts; and at least one lower connector, wherein the lower connector includes a plurality of lower strut receivers, and a lower batten receiver, wherein the first plurality of struts are removably inserted into the lower strut receivers, and wherein the lower batten receiver has a curvilinear cross section and a path length along the curvilinear cross section;

a second plurality of struts; and at least one upper connector, wherein the upper connector includes a plurality of upper strut receivers, and an upper batten receiver, wherein the second plurality of struts are removably inserted into the upper strut receivers, and wherein the upper batten receiver has the curvilinear cross section and the path length along the curvilinear cross section; and at least one batten having a longitudinal axis and a batten width perpendicular to the longitudinal axis, wherein the batten width is less than or equal to the path length, wherein the batten is flexed about the longitudinal axis to conform to the curvilinear cross section and wherein a first end of the batten is removably inserted in the lower batten receiver and a second end of the batten is removably inserted in upper batten receiver, wherein the first plurality of struts are inserted through respective first ones of the plurality of pockets along an upper edge of the fabric and wherein the second plurality of struts are inserted through second ones of the plurality of pockets along a lower edge of the fabric.

12. The toy of claim 11, wherein the at least one lower connector comprises three lower connectors, wherein the first plurality of struts form a lower frame, wherein the at least one upper connector comprises three upper connectors, wherein the second plurality of struts form an upper frame, wherein the at least one batten comprises three battens, and wherein the three battens join respective connectors of the upper frame and lower frame and resiliently support the upper frame above the lower frame.

13. The toy of claim 12, wherein the upper and lower frames form a tapered bow and square stern of a boat.

14. The toy of claim 12, wherein the fabric further comprises:

two side fabrics that extend between the upper frame and lower frame to form sides of a boat shape;

a stern fabric that extends between the upper and lower frame to form a stern of the boat shape; and a bottom fabric that extends between the first plurality of struts to form a bottom of the boat shape.

15. The toy of claim 14, wherein the bottom fabric is formed from a laminated cloth or tarp material.

16. The toy of claim 11, wherein one or more struts of the first plurality of struts and the second plurality of struts comprise:

a plurality of strut segments; and at least one collar, wherein the collar removably connects the strut segments end to end to form the strut.

17. The toy of claim 16, wherein the one or more struts further comprises a tether, wherein the plurality of strut segments and the collar comprise a hollow inner space, wherein the tether is fixed with ends of the one or more struts and extends through the hollow inner space.

* * * * *